US007049568B2

(12) United States Patent
Jeong

(10) Patent No.: US 7,049,568 B2
(45) Date of Patent: May 23, 2006

(54) WALL-MOUNTED TYPE MICROWAVE OVEN

(75) Inventor: Sang-Jin Jeong, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 7 days.

(21) Appl. No.: 10/455,322

(22) Filed: Jun. 6, 2003

(65) Prior Publication Data

US 2004/0134908 A1 Jul. 15, 2004

(30) Foreign Application Priority Data

Jan. 9, 2003 (KR) ..... 10-2003-0001437

(51) Int. Cl.
*H05B 6/80* (2006.01)

(52) U.S. Cl. ..... 219/757; 126/299 R; 312/296

(58) Field of Classification Search ..... 219/757, 219/756, 400, 686, 681, 683, 702; 126/299 R, 126/21 A, 21 R, 39 R, 110 R, 237 R, 273 R, 126/190; 312/296

See application file for complete search history.

(56) References Cited

U.S. PATENT DOCUMENTS

| | | | | |
|---|---|---|---|---|
| 2,860,026 | A * | 11/1958 | Long | 312/296 |
| 3,783,219 | A * | 1/1974 | Tateda | 219/757 |
| 4,812,617 | A * | 3/1989 | Takeuji et al. | 219/757 |
| 6,072,169 | A * | 6/2000 | Kang et al. | 219/702 |
| 6,586,716 | B1 * | 7/2003 | Lee | 219/757 |

FOREIGN PATENT DOCUMENTS

JP 02-046691 2/1990

* cited by examiner

*Primary Examiner*—Quang Van
(74) *Attorney, Agent, or Firm*—Staas & Halsey LLP

(57) ABSTRACT

A wall-mounted type microwave oven includes an oven body having a cooking chamber and an electrical component compartment which are isolated from each other, an exhaust flow path which is extended between a bottom and a top of the oven body to exhaust gas positioned below the oven body to the outside, an exhaust fan assembly which is provided at an outlet of the exhaust flow path, a convection fan which is provided at a side wall of the cooking chamber to forcibly circulate air in the cooking chamber, a convection motor which drives the convection fan, and a cooling flow path which cools the convection motor using the exhaust fan assembly. The exhaust fan assembly communicates with the outside of the microwave oven at an end thereof and is extended at the other end thereof to an inlet of the cooling flow path.

9 Claims, 4 Drawing Sheets

WALL-MOUNTED TYPE MICROWAVE OVEN

CROSS-REFERENCE TO RELATED APPLICATIONS

This application claims the benefit of Korean Application No. 2003-1437, filed Jan. 9, 2003, in the Korean Intellectual Property Office, the disclosure of which is incorporated herein by reference.

BACKGROUND OF THE INVENTION

1. Field of the Invention

The present invention relates a wall-mounted type microwave oven, and more particularly, to a wall-mounted type microwave oven having a motor which is simplified in its construction and is efficiently cooled.

2. Description of the Related Art

Generally, a wall-mounted type microwave oven is installed above an oven range in a cooking area, and carries out an operation to exhaust gas, fumes and the like generated from the oven range and a cooking operation to cook food.

A conventional wall-mounted type microwave oven includes an oven body having a cooking chamber which receive food and an electrical component compartment which is isolated from the cooking chamber. The wall-mounted type microwave oven further includes an exhaust path to exhaust gas and fumes generated from an oven range provided below the microwave oven. The exhaust path is defined between the cooking chamber and the electrical component compartment and the oven body such that the exhaust path surrounds bottom walls, side walls and top walls of the cooking chamber and the electrical component compartment. An exhaust fan is provided at a rear and upper portion of the oven body to discharge the gas and fumes guided through the exhaust path.

In another conventional wall-mounted type microwave oven, a heater is provided in a cooking chamber. The heater provides radiant heat to perform a cooking operation while a magnetron generates microwaves to perform the same. The wall-mounted type microwave oven is also provided with a convection fan and a convection motor for the convection fan, so as to forcibly circulate air in the cooking chamber and evenly disperse the radiated heat from the heater to the cooking chamber. The convection motor is provided with a cooling fan to cool the convection motor.

However, since the above-described wall-mounted microwave oven is constructed such that the convection motor includes the dedicated convection fan therein, a volume of the convection motor is increased, thereby complicating the installation of the convection motor to the wall-mounted type microwave oven and increasing the production cost.

SUMMARY OF THE INVENTION

Accordingly, it is an aspect of the present invention to provide a wall-mounted type microwave oven including a convection motor, which drives a corresponding convection fan, having a simplified construction to reduce the production cost, and which is efficiently cooled.

Additional aspects and advantages of the invention will be set forth in part in the description which follows and, in part, will be obvious from the description, or may be learned by practice of the invention.

To achieve the above and/or other aspects of the present invention, there is provided a wall-mounted type microwave oven comprising an oven body having a cooking chamber and an electrical component compartment which are isolated from each other, an exhaust flow path which extends between a bottom and a top of the oven body to exhaust gas positioned below the oven body to the outside of the microwave oven, an exhaust fan assembly which is provided at an outlet of the exhaust flow path, a convection fan which is provided at a side wall of the cooking chamber and forcibly circulates air in the cooking chamber, a convection motor which drives the convection fan, and a cooling flow path which communicates with the outside of the microwave oven at an end thereof and extends at the other end thereof to an inlet of the exhaust fan assembly to cool the convection motor provided in the cooling flow path by an operation of the exhaust fan assembly.

The microwave oven may further comprise a linking unit having two or more pulleys and a connecting belt, which connects the convection motor to the convection fan and transmit a turning force of the convection motor to the convection fan.

The cooling flow path may include an air inlet which is disposed at an upper portion of a front face of the oven body, a backward path section which communicates with the air inlet and guides air introduced through the air inlet toward the exhaust fan assembly by way of the convection motor, and a rear path section which extends between the backward path section and the inlet of the exhaust fan assembly.

The backward and rear path sections may be integrally formed with a duct provided on an upper surface of the oven body.

The exhaust fan assembly may include an exhaust motor and first and second exhaust fans which are joined to driving shafts extended from both ends of the exhaust motor. Each of the first and second exhaust fans may include a multi-blade centrifugal fan, an exhaust section to exhaust the gas introduced into the exhaust flow path to the outside, and a cooling section to cool the exhaust motor. The cooling flow path communicates with a space in which the exhaust motor is disposed.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
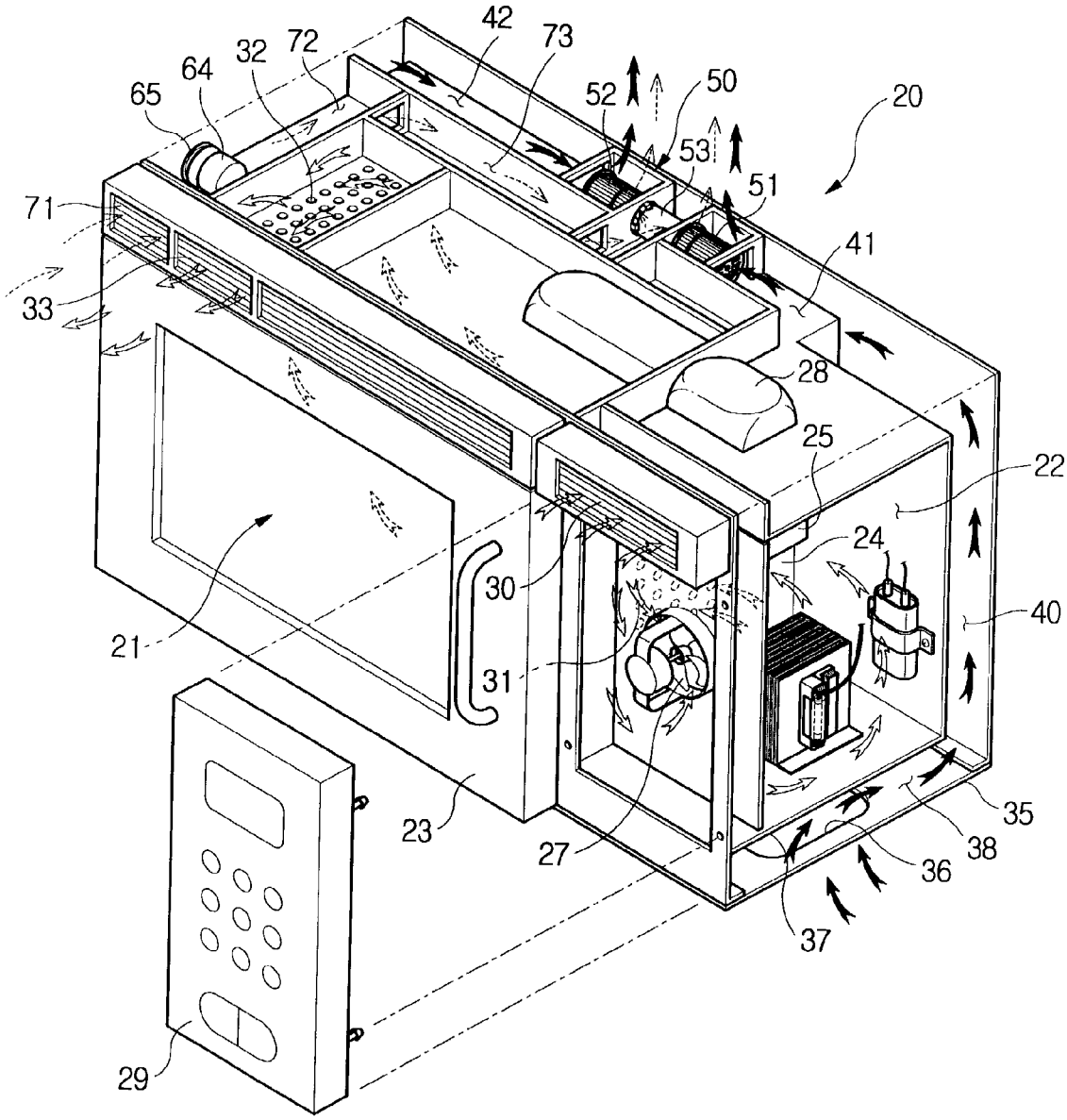
FIG. 1 is a perspective view of a wall-mounted type microwave oven according to an embodiment of the present invention.

Reference will now be made in detail to the present preferred embodiments of the present invention, examples of which are illustrated in the accompanying drawings, wherein like reference numerals refer to like elements throughout.

Figure 2:
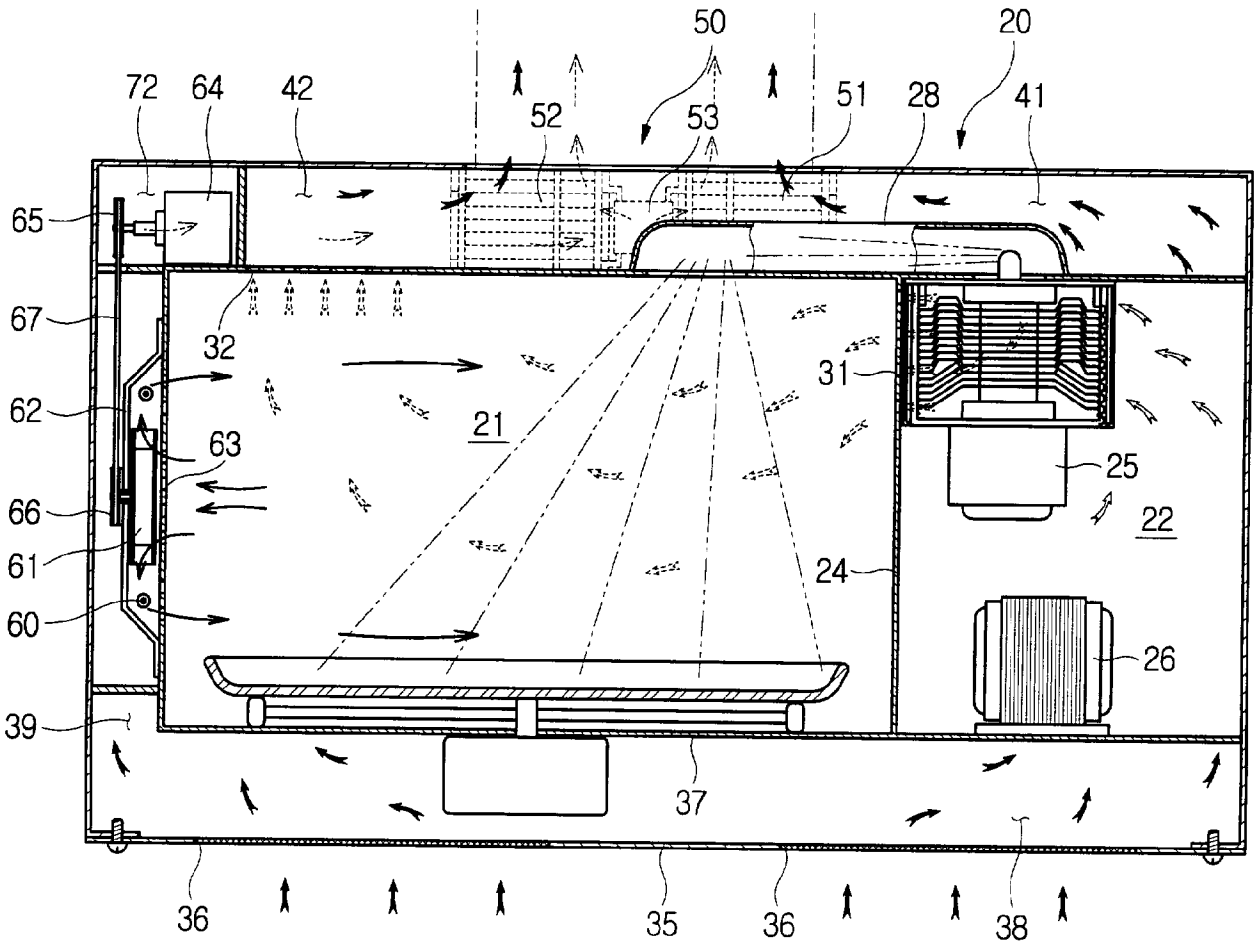
FIG. 2 is a front cross-sectional view of the wall-mounted type microwave oven of FIG. 1.

FIG. 1 shows a wall-mounted type microwave oven according to an embodiment of the present invention, and FIG. 2 shows a front cross-sectional view of the wall-mounted type microwave oven shown in FIG. 1.

As shown in FIGS. 1 and 2, the wall-mounted type microwave oven includes an oven body 20 having a cooking chamber 21 which receives food to be cooked, and an electrical component compartment 22 which houses various electrical components of the microwave oven. The cooking chamber 21 and the electrical component compartment 22 are isolated from each other.

The cooking chamber 21 is provided at its front with a door 23 to close and open the cooking chamber 21. The electrical component compartment 22 is isolated from the cooking chamber 21 by a partition plate 24. The electrical component compartment 22 is provided therein with a magnetron 25 which generates high-frequency electromagnetic waves, a high voltage transformer 26 which applies a high voltage to the magnetron 25, and a cooling fan 27 which cools the electrical components provided in the electrical component compartment 22. The magnetron 25 is mounted on an upper surface of the electrical component compartment 22, and the high voltage transformer 26 is mounted on the bottom of the electrical component compartment 22. A waveguide 28 is provided on upper surfaces of the cooking chamber 21 and the electrical component compartment 22 so as to extend between the upper surface of the cooking chamber 21 and the upper surface of the electrical component compartment 22. The waveguide 28 guides the high-frequency electromagnetic waves generated from the magnetron 25 into the cooking chamber 21. The electrical component compartment 22 is further provided at its front face with a control panel 29, equipped with a plurality of control buttons, which controls various operations of the microwave oven, and a display which indicates an operational condition of the microwave oven.

The microwave oven further includes an air flow path, which is adapted to allow outside air to be introduced into the electrical component compartment 22 and the cooking chamber 21, and then discharged to the outside, so as to cool the electrical component compartment 22 and ventilate the cooking chamber 21. The air flow path comprises a front air inlet 30 which is disposed over the control panel 29, communicates with the electrical component compartment 22 and allows outside air to be introduced into the electrical component compartment 22, and a plurality of vent holes 31 which are formed at the partition plate 24 and allow air introduced into the electrical component compartment 22 to flow into the cooking chamber 21 while cooling the electrical component compartment 22. The air flow path further comprises a plurality of vent holes 32 which are formed at an upper surface of the cooking chamber 21, and a front air outlet 33 which is disposed at an upper portion of a front face of the cooking chamber 21, so as to allow air in the cooking chamber 21 to be discharged to the outside therethrough.

In response to an operation of the cooling fan 27 installed in the electrical component compartment 22, the outside air is introduced into the electrical component compartment 22 through the front air inlet 21 to cool the components in the electrical component compartment 22, and then introduced into the cooking chamber 21 through the vent holes 31 of the partition plate 24 to ventilate the cooking chamber 21. Subsequently, the air in the cooking chamber 21 is discharged to the outside through the vent holes 32 and the front air outlet 33.

The microwave oven further includes an exhaust flow path which is constructed to be isolated from the cooking chamber 21 and the electrical component compartment 22 to exhaust gas and fumes generated from an oven range (not shown) disposed below the oven body 20. In connection with this, the oven body 20 is provided at its upper and rear portion with an exhaust fan assembly 50 which discharges the gas and fumes introduced into the exhaust flow path to the outside of the microwave oven.

The exhaust flow path comprises an intake port 35 which is formed at a bottom panel 35 of the oven body 20, a lower path section 38 which is defined between a bottom plate 37 of the cooking chamber 21 and the electrical component compartment 22 and the bottom panel 35 of the oven body 20, two rising path sections 39 and 40 which are defined between a side plate of the cooking chamber 21 and a rear plate of the electrical compartment 22 and vertical side panels of the oven body 20, and two upper path sections 41 and 42 which are disposed on the oven body 20 and guide the gas and fumes introduced into the rising path sections 39 and 40 toward the exhaust fan assembly 50. Accordingly, in response to the exhaust fan assembly 50 being operated, the gas and fumes sucked through the intake port 36 of the bottom panel 35 are discharged to the outside through the lower path section 38, the two rising path sections 39 and 40, and the two upper path sections 41 and 42.

The exhaust fan assembly 50 comprises first and second fans 51 and 52 which discharge the gas and fumes introduced into the two upper path sections 41 and 42, and a motor 53 which is interposed between the first and second fans 51 and 52, and rotates the first and second fans 51 and 52. More specifically, the first and second fans 51 and 52, which are spaced apart from each other, are joined to driving shafts extended from the opposite ends of the motor 53. In this embodiment, the first and second fans 51 and 52 may comprise multi-blade centrifugal fans which axially suck the gas and fumes in the upper path sections 41 and 42, and radially discharge the gas and fumes to the outside of the microwave oven.

Figure 4:
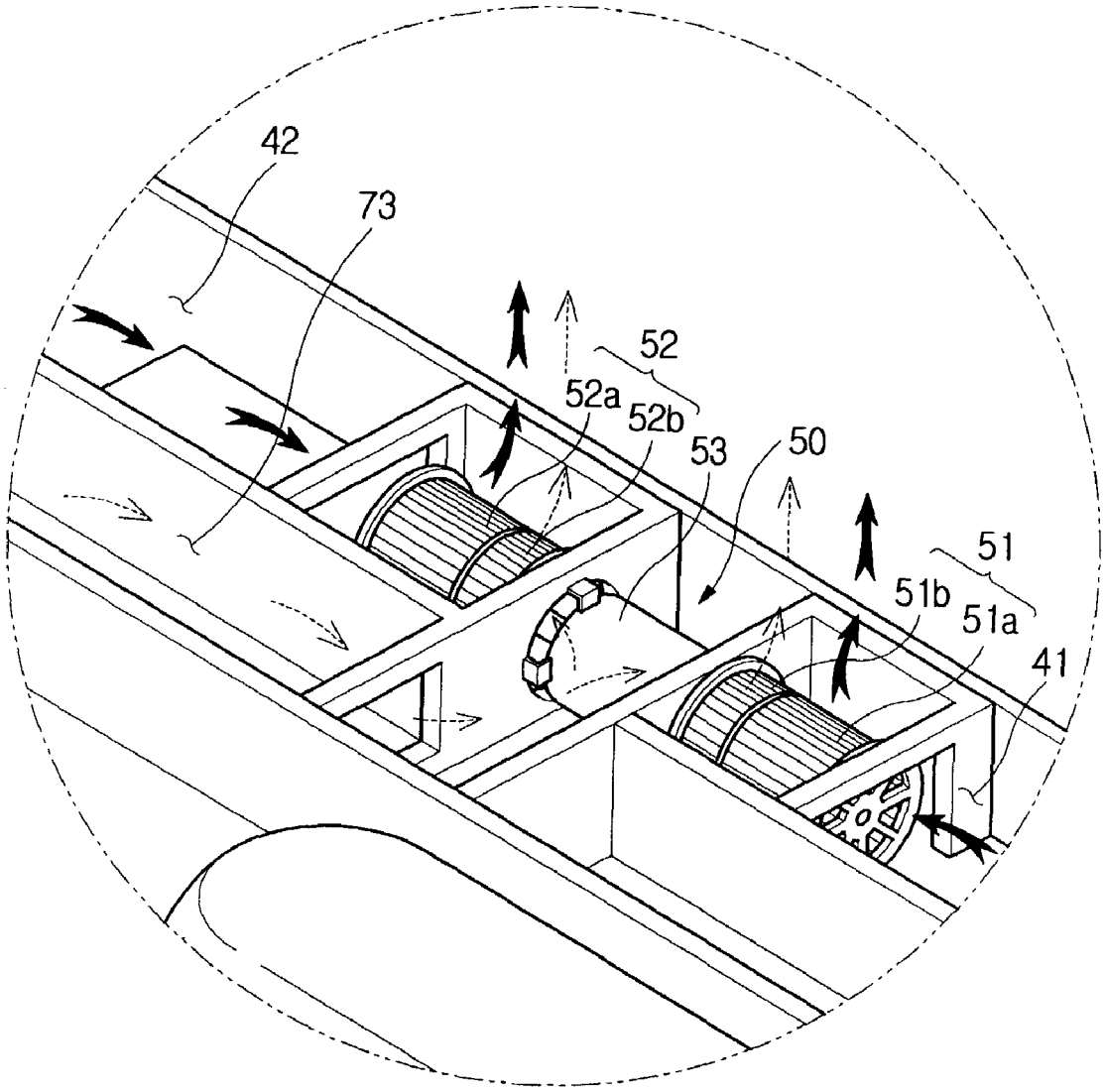
FIG. 4 is an enlarged perspective view of an exhaust fan assembly of the wall mounted type microwave oven of FIG. 1.

As shown in FIG. 4, the first and second fans 51 and 52 are divided into exhaust sections 51*a* and 52*a* to exhaust the gas and fumes in the exhaust flow path, and cooling sections 51*b* and 52*b* to cool the motor 53, respectively. For example, the cooling sections 51*b* and 52*b*, which are of a relatively small width, are positioned to be adjacent to the motor 53, and the exhaust sections 51*a* and 52*a*, which are of a relatively large width compared to that of the cooling sections 51*b* and 52*b*, are positioned at both the outer ends of the cooling sections 51*b* and 52*b*. Accordingly, air introduced into a chamber receiving the motor 53 is discharged to the outside of the microwave oven through the cooling sections 51*b* and 52*b* of the exhaust fan assembly 50, while cooling the motor 53, and the gas and fumes introduced into the upper path sections 41 and 42 are discharged to the outside of the microwave oven through the exhaust sections 51*a* and 52*a* of the exhaust fan assembly 50.

As shown in FIG. 2, the wall-mounted type microwave oven is provided at a side wall of the cooking chamber 21 with a heater 60 so as to enable food placed in the cooking chamber 21 to be cooked by high-temperature heat during, for example, a cooking operation by the high-frequency electromagnetic waves. The microwave oven further includes a convection fan 61 in a space defined in the heater 60, so as to forcibly circulate the air in the cooking chamber 21. In this case, the convection fan 61 is covered with a fan casing 62 mounted on an outer side surface of the cooking chamber 21, and the heater 60 is positioned in the fan casing 62 so as to surround the convection fan 61. The side wall of the cooking chamber 21, on which the convection fan 61 is mounted, includes a plurality of through holes 63 to allow the air in the cooking chamber 21 to be circulated through the space in the fan casing 62 by the operation of the convection fan 61.

Figure 3:
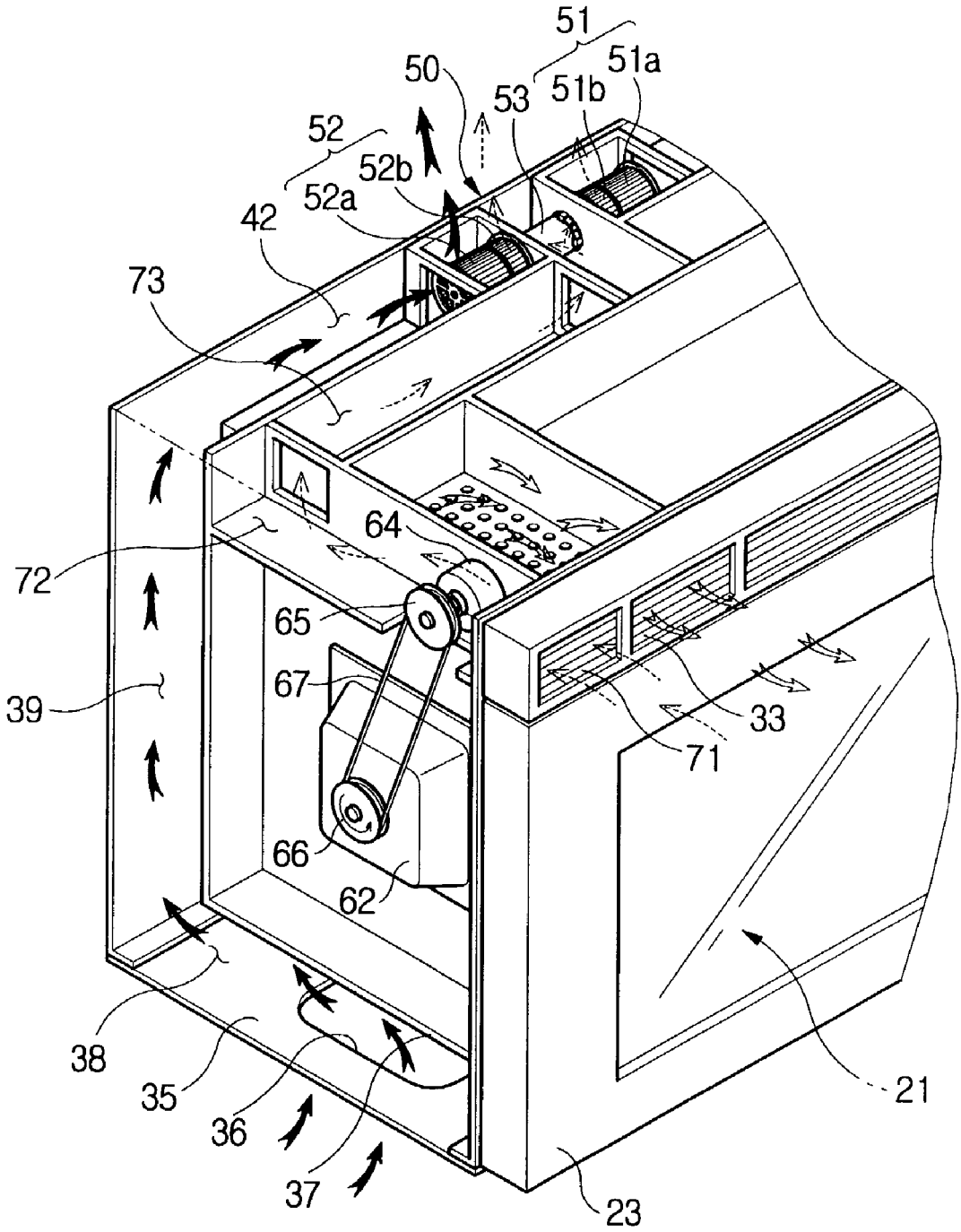
FIG. 3 is a perspective view of a side part of the wall-mounted type microwave oven of FIG. 1, which shows a convection motor and a cooling flow path.

As shown in FIG. 3, the oven body 20 of the microwave oven is provided at a side and upper portion thereof with a convection motor 64 which drives the convection fan 61. The convection motor 64 and the convection fan 61 include corresponding pulleys 65 and 66 which are joined to rotating shafts thereof, respectively. A connecting belt 67 is provided between the pulley 65 of the convection motor 64 and the pulley 66 of the convection fan 61 to allow the pulley 66 of the convection fan 61 to be rotated together with the convection motor 64. Since the convection motor 64 is installed at an upper portion of the oven body 20, a width or the overall length of the oven body 20 is reduced, and the convection fan 61 is smoothly rotated.

The microwave oven further includes a cooling flow path which enables the convection motor 64 to be cooled without an additional cooling fan. As shown in FIGS. 1–3, the cooling flow path comprises an air inlet 71 which is disposed at an upper portion of the front face of the oven body 20 and allows outside air to be introduced into the oven body 20, a backward path section 72 which communicates with the air inlet 71 and is extended rearward by way of the convection motor 74, and a rear path section 73 which is extended between the backward path section 72 and the chamber receiving the motor 53 of the exhaust motor assembly 50.

Accordingly, where the first and second fans 51 and 52 of the exhaust fan assembly 50 are rotated, outside air is introduced into the backward path 72 through the air inlet 71 while cooling the convection motor 64, by a suction action of the cooling sections 51*b* and 52*b* of the first and second fans 51 and 52, and the air in the backward path section 72 is guided into the space receiving the motor 53 through the rear path section 73. Thereafter, the air in the space is discharged to the outside while cooling the exhaust motor 53. Therefore, the cooling flow path enables the convection motor 64 to be cooled without an additional cooling fan. The cooling flow path may be integrally formed with ducts by an injection molding process, which are provided at an upper surface of the oven body 20 to divide the upper space of the oven body 20 into flow paths such as the exhaust flow path and the ventilation flow path.

An operation of the wall-mounted type microwave oven according to the present invention will now be described.

To perform a cooking operation using high-frequency electromagnetic waves, food is placed in the cooking chamber 21 and the magnetron 25 is operated. At this time, the high-frequency electromagnetic waves irradiated from the magnetron 25 are supplied into the cooking chamber 21 through the waveguide 28 to cook the food in the cooking chamber 21. In addition, outside air is sucked into the electrical component compartment 22 through the front air inlet 30 by an operation of the cooling fan 27 in the electrical component compartment 22, thereby cooling the various electrical components provided in the electrical component compartment 22. Subsequently, the air in the electrical component compartment 22 is introduced into the cooking chamber 21 through the vent holes 31 formed at the partition plate 24, and then discharged to the outside through the vent holes 32 of the cooking chamber 21 and the front air outlet 33, thereby ventilating the cooking chamber 21.

In addition to performing the cooking operation using the high-frequency electromagnetic waves and discharging gas and fumes generated from an oven range (not shown) disposed below the oven body 20 by using the exhaust flow path and the exhaust fan assembly 50, the present microwave oven can also perform a cooking operation using heat generated from the heater 60 installed at the side wall of the cooking chamber 21.

Where the exhaust fan assembly 50 is operated to discharge the gas and fumes generated from the oven range disposed below the oven body 20, the gas and fumes are introduced into the lower path section 38 through the intake port 36 of the bottom panel 35, and then discharged to the outside through the two rising path sections 39 and 40, and the two upper path sections 41 and 42.

Where a cooking operation using the heater 60 is performed, the heater 60 is heated by electric power, and the convection fan 61 is rotated by the convection motor 64. Accordingly, air in the cooking chamber 21 is introduced into the fan casing 62 through the through holes 63, and radially discharged and circulated into the cooking chamber 21 while being heated by the heater 60. Consequently, food placed in the cooking chamber 21 is cooked by the hot air, which is heated by the heater 60 and circulated in the cooking chamber 21.

Where the cooking by the convection fan 61 and the heater 60 is performed, a cooling of the convection motor 64 and the exhaust motors 53 is achieved by air introduced into the cooling flow path using a suction action of the cooling sections 51*b* and 52*b* of the exhaust fan assembly 50. That is, air sucked into the backward path section 72 through the air inlet 71 of the oven body 20 is introduced into the space receiving the exhaust motors 53 while cooling the convection motor 64, and then discharged to the outside while cooling the exhaust motors 53. Therefore, the wall-mounted type microwave oven according to the present invention enables the convection motor 64 to be cooled by the exhaust fan assembly 50. Accordingly, a separate cooling device is not needed to cool the convection motor 64 as is with a conventional wall-mounted type microwave oven having a heater.

As described above, the present invention provides a wall-mounted type microwave oven having a convection motor which is cooled by air introduced into a cooling flow path using a suction action of an exhaust fan. Accordingly, an additional cooling fan is not necessary to cool the convection motor, thereby simplifying the structure of the convection motor and reducing the production cost of the microwave oven, as compared to a convention wall-mounted type microwave oven.

Although a preferred embodiment of the present invention has been shown and described, it would be appreciated by those skilled in the art that changes may be made in these embodiments without departing from the principles and spirit of the invention, the scope of which is defined in the claims and their equivalents.

What is claimed is:

1. A wall-mounted type microwave oven comprising:

an oven body having a cooking chamber and an electrical component compartment which are isolated from each other;

an exhaust flow path which extends between a bottom and a top of the oven body to exhaust gas positioned below the oven body to an outside of the microwave oven;

an exhaust fan assembly having an exhaust motor and being provided at an outlet of the exhaust flow path;

a convection fan which is provided at a side wall of the cooking chamber and forcibly circulates air in the cooking chamber;

a convection motor which drives the convection fan; and a cooling flow path which communicates with the outside of the microwave oven at an end thereof and extends at the other end thereof to an inlet of the exhaust fan assembly to cool the convection motor and the exhaust motor provided in the cooling flow path by an operation of the exhaust fan assembly, wherein the exhaust fan assembly comprises first and second exhaust fans which are joined to driving shafts extended from both ends of the exhaust motor, each of the first and second exhaust fans includes a multi-blade centrifugal fan, an exhaust section to exhaust the gas introduced into the exhaust flow path to the outside, and a cooling section to cool the exhaust motor, and the cooling flow path communicates with a space in which the exhaust motor is disposed.

2. The wall-mounted type microwave oven as set forth in claim 1, further comprising:

a linking unit having two or more pulleys and a connecting belt, which connects the convection motor to the convection fan and transmits a turning force of the convection motor to the convection fan, wherein the convection motor is disposed at a side and upper portion of the cooking chamber.

3. The wall-mounted type microwave oven as set forth in claim 2, wherein the cooling flow path comprises:

an air inlet which is disposed at an upper portion of a front face of the oven body;

a backward path section which communicates with the air inlet and guides air introduced through the air inlet toward the exhaust fan assembly by way of the convection motor; and a rear path section which extends between the backward path section and the inlet of the exhaust fan assembly.

4. The wall-mounted type microwave oven as set forth in claim 3, wherein the backward and rear path sections are integrally formed with a duct provided on an upper surface of the oven body.

5. The wall-mounted type microwave oven as set forth in claim 1, wherein the cooling flow path is integrally formed with a duct provided on an upper surface of the oven body.

6. The wall-mounted type microwave oven as set forth in claim 1, wherein air introduced through the cooling flow path to cool the convection motor and the exhaust motor is discharged to the outside through the cooling sections of the first and second exhaust fans.

7. The wall-mounted type microwave oven as set forth in claim 1, further comprising:

a heating unit to cook food, wherein the heating unit includes:

a magnetron which generates microwaves to cook the food; and a heater which heats the air in the cooking chamber, wherein the convection fan circulates the heated air in the cooking chamber.

8. The wall-mounted type microwave oven as set forth in claim 1, further comprising:

a circulation flow path which guides outside air to cool the electrical component compartment and ventilate the cooking chamber.

9. The wall-mounted type microwave oven as set forth in claim 8, wherein the circulation flow path comprises:

an air inlet which introduces the outside air into the electrical component compartment;

one or more inlet vent holes which introduce the outside air from the electrical component compartment to the cooking chamber and are formed on a partition plate of the oven body that separates the electrical component compartment from the cooking chamber; and an air outlet which discharges the outside air introduced into the cooking chamber to the outside.

* * * * *